United States Patent [19]

Pearson

[11] 4,026,091

[45] May 31, 1977

[54] ARTICLE HANDLING AND PLACEMENT APPARATUS

[76] Inventor: Walter G. Pearson, P.O. Box 5542, Alexandria, La. 71301

[22] Filed: Mar. 25, 1976

[21] Appl. No.: 670,510

[52] U.S. Cl. ..... 53/390; 53/160; 53/247

[51] Int. Cl.[2] ..... B65B 67/02; B65B 5/08

[58] Field of Search ..... 53/247, 166, 390; 294/64 R, 64 A, 64 B

[56] References Cited

UNITED STATES PATENTS 1,526,405 2/1925 Williams ..... 294/64 R 3,523,706 8/1970 Logue ..... 294/64 B

FOREIGN PATENTS OR APPLICATIONS 703,364 2/1954 United Kingdom ..... 53/247

*Primary Examiner*—Travis S. McGehee
*Attorney, Agent, or Firm*—Robert K. Rhea

[57] ABSTRACT

Apparatus, including a vacuum head assembly, connected with a source of vacuum, for lifting a predetermined number of small articles from a supply location and individually depositing them on a sheet-like receptacle, containing a like number of cup-like sockets, supported by a base.

2 Claims, 8 Drawing Figures

ARTICLE HANDLING AND PLACEMENT APPARATUS

BACKGROUND OF THE INVENTION

1. Field of the Invention

The present invention relates to apparatus for handling small articles and more particularly to a suction head assembly registering with a base for transferring a plurality of drugs, such as tablets or capsules from a supply location to a container forming a part of a blister-pack-type prepack drug card.

It is common practice to prepackage drugs such as capsules or tablets in blister pack card-like form wherein the container is provided with a plurality of sockets individually numbered from 1 to 30 so that the tablets may be successively removed, one at a time, from the card and consumed each day of a month. It is a time consuming operation to place the tablets in the individual sockets when assembling the card-like container. It is generally required by Law that the drugs be assembled by a registered pharmacist, thereby increasing the cost of packaging the drugs, particularly where a relatively large number of such prepackaged drugs must be assembled as needed or a prepackaged supply kept in inventory.

This invention provides an apparatus for simultaneously transferring a one month supply of tablets or capsules from a supply point to the sockets of a receptacle forming a part of the card-like container in approximately the same time required for the transfer and placement of one tablet or capsule, thus reducing the drug handling time to a minimum.

2. Description of the Prior Art

It is known to use suction or vacuum for lifting for moving small articles from one location to another, by creating a pressure differential across its opposing surfaces, such as for planting seeds in a seed bed as disclosed by U.S. Pat. No. 2,704,685 or moving delicate waffer-like articles by air currents, such as disclosed by Patent No. 3,523,706.

The seed planting apparatus is concerned with the spacing of seeds and no arrangement is disclosed for placing the seeds in a particular location.

The waffer transferring apparatus is concerned with moving a fragile single waffer to a specific assembly location rather than simultaneously moving a plurality thereof.

This invention proposes using a suction head assembly having a plurality of apertures arranged in a predetermined pattern which cooperates with a base supporting a receptacle having a similarly arranged array of sockets for registering the suction head assembly with the base and the sockets.

SUMMARY OF THE INVENTION

A generally flat rectangular base is provided with an upwardly open recess for receiving a transparent sheet containing a predetermined number of upwardly open cup-like sockets arranged by rows in equally spaced relation. The base is provided with upstanding guide walls along one side and one end for registering a generally flat rectangular suction head assembly with the marginal edges of the base.

The suction head assembly defines a chamber having a transparent top wall and a transparent bottom wall. The bottom wall is provided with a plurality of apertures similarly arranged by rows in equally spaced relation and extending longitudinally of the head for registration with the sheet receptacle sockets. The top wall is provided, at one end portion, with a port for connection with a tube connected with a vacuum pump tube and at its other end portion with an opening diametrically at least equal to the diameter of the vacuum tube aperture for applying vacuum pull to the chamber and releasing the vacuum pull.

The principal object of this invention is to provide a suction head assembly having a plurality of article contacting apertures in one surface for lifting articles contacted from a supply location in which the suction head is then registered with a base supporting a sheet-like article receiving receptacle for individually depositing the articles in upwardly open sockets formed in the receptacle when the vacuum pull is released from the head assembly.

DESCRIPTION OF THE PREFERRED EMBODIMENTS

Figure 2:
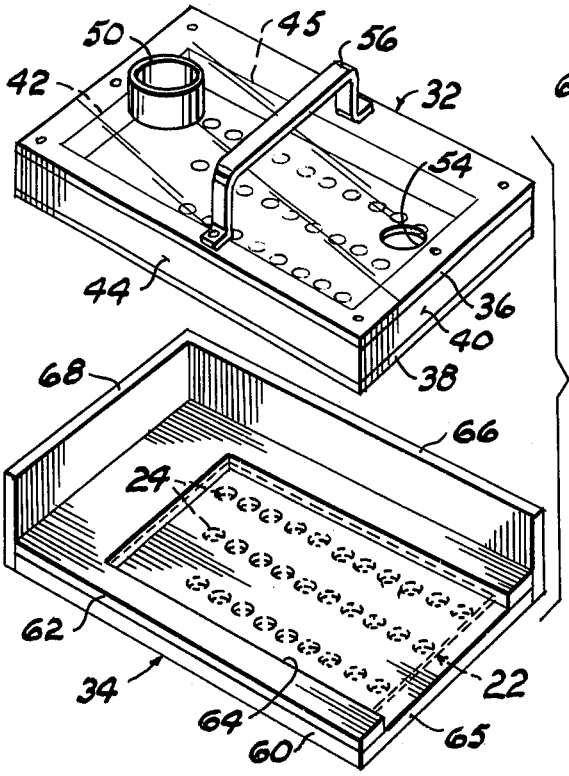
FIG. 2 is an exploded perspective view of the device illustrating, by dotted lines, the relative position of the sheet receptacle when supported by the base.
Figure 1:
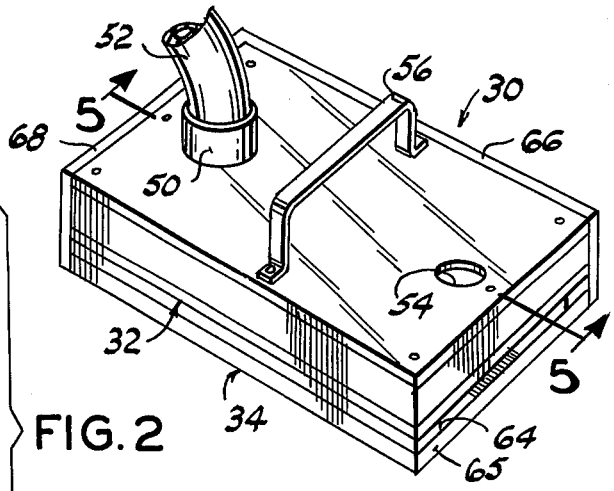
FIG. 1 is a perspective view of the device.
Figure 3:
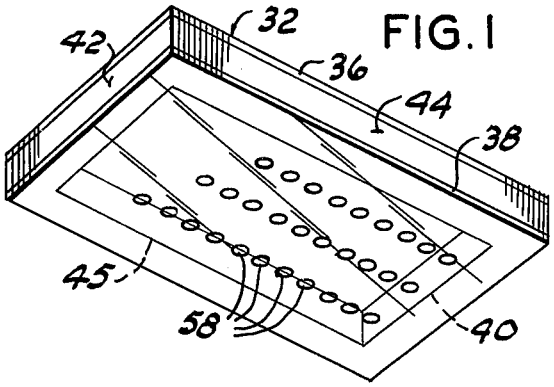
FIG. 3 is a perspective view of the bottom surface of the suction head assembly.
Figure 5:
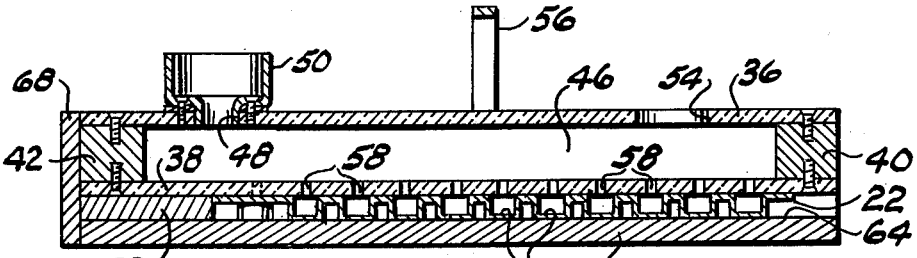
FIG. 5 is a vertical cross sectional view, to a larger scale, taken substantially along the line 5—5 of FIG. 1.

Like characters of reference designate like parts in those figures of the drawings in which they occur.

Figure 7:
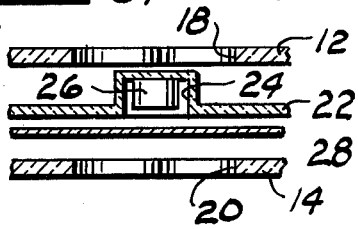
FIG. 7 is a fragmentary vertical cross sectional view, to another scale, taken substantially along the line 7—7 of FIG. 6 with the components shown in exploded relation for clarity; and, FIG. 8 is a fragmentary vertical cross sectional view, to a different scale, illustrating one tablet when supported by one aperture in the bottom wall.
Figure 6:
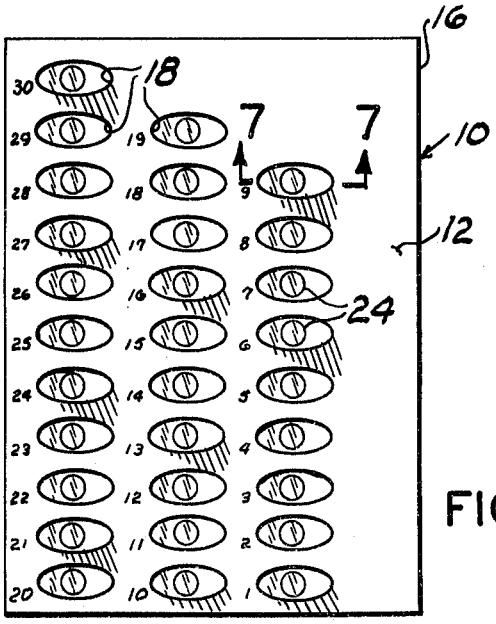
FIG. 6 is a top plan view of an assembled prepackaged tablet containing card.
Figure 4:
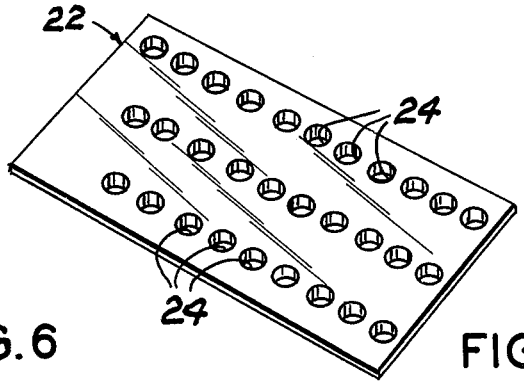
FIG. 4 is a perspective view of a tablet receiving sheet having sockets to be filled with tablets.

In the drawings:

Referring first to FIGS. 4, 6 and 7, the reference numeral 10 indicates a card-like container providing a 30 day supply of tablets. The card-like container includes top and bottom panels 12 and 14 joined along one side edge 16 in book form and each provided with equally spaced ovate apertures 18 and 20, respectively, which are in registration when one panel 12 or 14 overlies the other. The ovate apertures are arranged in equally spaced parallel rows extending longitudinally of the covers with the apertures 18 consectively numbered, on the outer surface of the panel 12, from 1 through 30.

The card 10 further includes a tray-like transparent sheet receptacle 22, relatively thin when compared with its overall dimensions, which are less than the overall dimensions of the respective panels 12 and 14. The sheet 22 contains a like plurality of cup-like sockets 24 open toward one of its flat surfaces and projecting laterally outward of its opposite surface a selected distance greater than the thickness of the tablets 26 or capsules, not shown, to be individually received therein wherein the wall forming each socket 24 projects through the respective top cover ovate aperture 18. The sockets 24 are filled with tablets 26, only one being shown (FIG. 7), and a thin sheet such as a sheet of tinfoil 28 is placed in overlying relation on the sheet 22 to cover the tablets and socket openings. When placed between the panels 12 and 14, the sheet 22 and tinfoil 28 are disposed so that when the panels 12 and 14 are closed toward each other the tablets are securely maintained in the respective socket. The meeting surfaces of the respective components are then sealed together to form the completed card 10.

The tablets 26 are removed by simply breaking the tinfoil 28 in that area overlying the respective tablet 26 and within the back panel ovate opening 20.

The above description is conventional with prepackaged 30 day supply type card-like containers and is set forth to show the relationship of the invention to the process of assembling tablets or capsules when assembling each card-like container 10.

The reference numeral 30 indicates the apparatus, as a whole, which is rectangular box-like in general configuration comprising a head assembly means 32 and a base means 34. The suction head assembly 32 includes a flat-like box structure formed by superposed sheet-like top and bottom walls 36 and 38, respectively, maintained in vertically spaced relation by end members 40 and 42 integrally joined with side members 44 and 45 to define a central chamber 46. The longitudinal and transverse dimensions of the suction head 32 is preferably greater than the corresponding transverse and longitudinal dimension of the sheet 22 for the purposes believed readily apparent. The top and bottom walls 36 and 38 are preferably formed from transparent plastic material for the reasons presently explained.

The top wall 36 is provided, at its end portion adjacent the end member 42, with a port 48 communicating with a coupling 50 secured to the outer surface of the wall 36 which accepts one end portion of a flexible tube 52 connected with a source of vacuum, not shown. At its other end portion, adjacent the end member 40, the top wall 36 is provided with an opening 54, diametrically at least equal with the diameter of the port 48, which is manually opened and closed by the operator for applying and releasing the vacuum pull within the chamber 46 as explained hereinbelow. The head 32 may be provided with a handle 56, or the like, for ease in moving the head.

Figure 8:
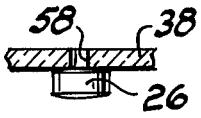

The bottom wall 38 is provided with a plurality of equally spaced rows, three in the example shown, of equally spaced-apart apertures 58, each having a diameter less than the diameter of the capsules or tablets 26 to be lifted and transferred by the head (FIG. 8). The spacing between the rows and spacing between the apertures 58 in each row is such that the apertures are co-axially aligned with the cup-shaped sockets 24 in the sheet 22 when the head 32 is registered with the base 34 as explained hereinbelow.

The base 34 comprises a flat panel base 60 having transverse and longitudinal dimensions substantially equal to the overall corresponding dimensions of the head assembly 32.

A spacer 62, formed of similar flat panel material, flatly overlies and is secured to the upper surface of the base 60, as viewed in the drawings. The spacer 62 is provided with a rectangular recess 64 open at its end toward the base end 65 and dimensioned to nest the marginal side edges and one end edge of the sheet 22 when it is flatly disposed upon the upper surface of the base 60 within the recess 64.

One longitudinal side of the base 60 is provided with an upstanding guide wall 66 having a vertical height extending above the upper limit of the spacer 62 a distance substantially equal to the vertical thickness of the head 32. The base 60 is also provided with an end guide wall 68 at its end opposite the open end of the recess 64. The purpose of the guide walls 66 and 68 is to form a stop by contiguous contact with the longitudinal side edge surface and end edge surface of the head 32 defined by the outer surface of the head top and bottom wall spacers 45 and 42, respectively, thus insuring vertical coaxial alignment of the bottom wall apertures 58 with the cup-like sockets 24.

OPERATION

In operation, a supply of capsules or tablets 26 to be inserted into the sheet sockets 24 are preferably disposed on a table-like panel, not shown, having a slight incline and vibrated in a conventional manner to maintain the tablets in close juxtaposed relation and encompass an area of greater dimension than the overall dimensions of the head assembly bottom wall 38. One of the sheets 22 is disposed within the base recess 64 with the sockets opening upwardly, as shown in FIGS. 2 and 4. The head assembly 32, connected with the vacuum source tube 52, is manually positioned in overlying relation on the supply of tablets 26. The operator then closes the opening 54 by placing his hand thereover thus reducing the pressure within the chamber 46 and creating a pressure differential across each tablet 26 underlying the respective head aperture 58. The operator then manually positions the head assembly 32, on the base 34 against the guide walls 66 and 68 after visual inspection of the apertures 58 through the transparent top and bottom walls 36 and 38 to insure that each aperture 58 is closed by a tablet 26. Thereafter the operator breaks the vacuum pull within the chamber 46 by removing his hand from the opening 54 thus releasing the tablets 26 to fall by gravity into the respective sheet socket 24. The head assembly 32 is removed from the base and the filled sheet 22 assembled with its components to form the completed tablet packed card 10 as previously explained. Obviously other means, such as a flap valve, not shown, may be employed for opening and closing the vacuum breaking opening 54.

Obviously the invention is susceptible to changes or alterations without defeating its practicability. Therefore, I do not wish to be confined to the preferred embodiment shown in the drawings and described herein.

I claim:

1. Apparatus for lifting a predetermined number of articles from a supply location and depositing them on a sheet-like receptacle containing a like number of article receiving sockets arranged in a predetermined array by creating a pressure differential across the articles, comprising:

generally flat base means having an upwardly open recess for receiving and horizontally supporting said sheet-like receptacle therein and having at least two upstanding cooperating guide walls spaced outwardly from the recess;

generally flat head assembly means including a box structure having a hollow interior forming a chamber and being in overlying registration with said base means when superposed thereon and in contact with said guide walls and having a generally flat top wall and flat bottom wall, said top wall having a port provided with a coupling communicating with the chamber; and, a flexible tube connected, at one end, with a source of vacuum and connected, at its other end, with said coupling, said bottom wall having a plurality of apertures providing communication between the chamber and the ambient air and being arranged in cooperative vertically spaced relation with respect to the receptacle sockets when said head assembly means overlies said base means.

2. The apparatus according to claim 1 in which said top wall is provided with a manually opened and closed vacuum control opening.

* * * * *